US005664297A

United States Patent [19]

Mandukian

[11] Patent Number: 5,664,297

[45] Date of Patent: Sep. 9, 1997

[54] BOLO TIE-TYPE DEVICE AND SECURING MEANS THEREFOR

[76] Inventor: Chant H. Mandukian, 6131 N. 51st Pl., Paradise Valley, Ariz. 85253

[21] Appl. No.: 640,243

[22] Filed: Apr. 30, 1996

[51] Int. Cl.[6] ..... A41D 25/14; A47G 25/74

[52] U.S. Cl. ..... 24/66.9; 24/115 H; 24/129 R; 2/148

[58] Field of Search ..... 2/144, 145, 148–150, 2/155; D2/607; 24/66.9, 115 H, 129 R, 136 R, 18, 30.5 P, 122.6, 16 PB

[56] References Cited

U.S. PATENT DOCUMENTS

| | | | |
|---|---|---|---|
| 88,373 | 3/1869 | d'Heureuse . | |
| 255,729 | 7/1882 | Harriman | D2/352 |
| 297,071 | 4/1884 | Doremus . | |
| 1,379,093 | 5/1921 | Freeberg . | |
| 2,637,884 | 5/1953 | Morehouse | 24/81 |
| 2,846,688 | 8/1958 | Meeker | 2/150 |
| 2,877,527 | 3/1959 | Bond | 24/115 H |
| 2,896,217 | 7/1959 | Cedarstaff | 2/150 |
| 3,075,266 | 1/1963 | Gaupp | 24/116 |
| 3,187,396 | 6/1965 | Carroll | 24/123 |
| 3,364,500 | 1/1968 | Fox | D2/607 X |
| 3,675,277 | 7/1972 | Day | 24/66.9 |
| 3,745,614 | 7/1973 | Tsang | 2/148 |
| 3,813,737 | 6/1974 | Larsen | 24/49 S |
| 4,035,873 | 7/1977 | Epperson | 24/49 S |
| 4,038,724 | 8/1977 | Parizek | 24/66.9 |
| 4,106,123 | 8/1978 | Freedman | 24/129 R X |
| 4,162,561 | 7/1979 | Tillemans | 24/129 R |
| 4,188,435 | 2/1980 | Bartrug | 24/129 R X |
| 5,008,981 | 4/1991 | Smithson | 24/49 R |
| 5,136,758 | 8/1992 | Wilcox et al. | 24/66.9 X |
| 5,323,992 | 6/1994 | Sifers et al. | 24/129 R X |
| 5,345,656 | 9/1994 | Merritt | 24/115 H |
| 5,372,510 | 12/1994 | Stanfield | 24/115 H X |
| 5,416,925 | 5/1995 | Davis | 2/144 |
| 5,461,726 | 10/1995 | Wade | 2/144 |

*Primary Examiner*—Peter M. Cuomo
*Assistant Examiner*—Robert J. Sandy
*Attorney, Agent, or Firm*—Richard R. Mybeck; Peter B. Scull

[57] ABSTRACT

A bolo tie or the like device for displaying ornamentation and/or identification thereon. The present bolo tie-type device has a cord member of sufficient length to pass behind the wearer's neck and provide two depending ends therefrom and a display/securing member having a front surface and a back surface, the front surface being suitable to support decorative and/or identifying indicia thereupon, the back surface having securing means defined thereon for holding the display/securing member in a preselected position relative to the depending ends of the cord member and preventing involuntary movement thereof regardless of the wearer's activity. The securing means comprises a plurality of strategically disposed post members for receiving the depending ends of the cord member therethrough in secure, non-slipping relationship therewith. Preferably, there are two sets of post members which include a first and a second cylindrical post member substantially vertically aligned with each other in a spaced relationship therebetween. Each set may further include respective third post members or there may be a singular third post shared between the two sets. The third post member(s) are disposed intermediate of each first and second cylindrical post member and offset from the vertical alignment thereof and having a notch defined therein on the lower interior side thereof.

17 Claims, 1 Drawing Sheet

BOLO TIE-TYPE DEVICE AND SECURING MEANS THEREFOR

The present invention relates generally to a bolo tie-type device and securing means therefor and more particularly to unique means and methods for securing the ornamental display of a bolo tie-type device to hold the display in a preselected position relative to a user's neck. More particularly, the present invention involves novel securing means comprising a plurality of posts strategically disposed on the back surface of the ornamental display and coactive with an elongated bolo cord to prevent involuntary movement of the ornamental display along the bolo cord.

BACKGROUND OF THE INVENTION

A variety of means for clasping cords in a way to permit the selective adjustment thereof have been developed in the art. Some of the more elaborate include those which use spring-biased pins or pushbuttons to effect the engagement or disengagement of the cord clasping device with the cord passing therethrough. Examples of such devices are described inter alia in Smithson, U.S. Pat. No. 5,008,981, and Larsen, U.S. Pat. No. 3,813,737. A similar device though not taught for use on bolo ties is described in Freeberg, U.S. Pat. No. 1,379,093. Yet another, similar clasp device is described in Doremus, U.S. Pat. No. 297,071. While the Doremus device is not spring-biased, it does include distinct moving parts to effect locking engagement with the cord passing therethrough.

Less elaborate securing devices, which for example have no moving parts, are also described in the art. Some of these kinds of devices include clasps having spring-like members which are disposed to be biased against the bolo cord to hold the securing device secure relative thereto. Examples of these kinds of devices are described in Carroll, U.S. Pat. 3,187,396; Gaupp, U.S. Pat. No. 3,075,266; and Morehouse, U.S. Pat. No. 2,637,884.

Other prior art securing devices, which also have no moving parts, include those which rely primarily on friction to keep the securing device in place relative to the cord. Of these, Davis, U.S. Pat. No. 5,416,925; Epperson, U.S. Pat. No. 4,035,873; Cedarstaff, U.S. Pat. No. 2,896,217; and Meeker, U.S. Pat. No. 2,846,688, are typical. All of these involve two distinct portions of the securing device which are formed to be wrapped around two distinct portions of the bolo cord. The friction force is supplied in each of these examples by means distinct from the wrap-around portions. In Davis, a tongue member wraps over the top of the securing device between the portions of the cord held therein to apply friction thereto. In Epperson, a horseshoe-shaped projection coacts with a wire frame to hold the cord in place. Meeker uses a special indentation in the securing device where the securing device wraps around the cord to apply the frictional holding force. Cedarstaff is similar to Meeker but further includes two small protrusions to provide an additional restraint for the bolo cord.

A slightly different form of cord restraint is taught by d'Heureuse, U.S. Pat. No. 88,373. d'Heureuse describes several wrap around sheath-type structures which have notches or slots that are used to receive and secure the cord in a preferred position.

Even so, there remains an unfilled need for a simple, effective securing means for bolo tie-type devices which provides a stable relationship between the bolo cord and the ornamental display to avoid involuntary movement of the display relative to the cord. Such a device should also be simple to manufacture and easy to use. It is toward these desiderata that the present invention is directed.

BRIEF SUMMARY OF THE INVENTION

The present invention relates generally to bolo tie-type devices and more particularly to means for simply and firmly securing the ornamental displays of such devices relative to the tie cord to prevent the involuntary movement thereof while worn. A bolo tie of the present invention generally includes a cord to be worn around the user's neck and an ornamental display/securing device having an ornamental display on the front surface and unique securing means on the back surface thereof. The securing means generally comprises a plurality of projections or "posts" integrally and strategically formed on the back surface of the ornamental display/securing device to define operative sets. In one embodiment, each set of posts includes three posts disposed in a triangular pattern when viewed in plan and are herein referred to as an upper post, a lower post and an intermediate post. The two ends of the bolo cord are separately received and frictionally secured within each of these triangular post formations in a manner to be more fully described. The orientation of posts in each set is such that it imposes a slightly serpentine-like configuration to that portion of the bolo cord which is passed therethrough. Preferably, the intermediate post, which may be common to both sets, has a notch defined therein to present an upper lip which, as will appear, provides greater cord retaining ability.

Accordingly, the primary object of the present invention is to provide a bolo tie-type device having improved, simple to manufacture, easy to use securing means operatively associated therewith.

Still another object of the present invention is to provide a new and improved bolo tie-type device in which an ornamental or identification display can be confidently positioned by the wearer with assurance that no involuntary movement will occur during the wearing thereof.

A still further object of the present invention is to provide novel and reliable securing means for bolo tie-type devices which obtain beneficial results without employing moving parts.

These and still further objects as shall hereinafter appear are readily fulfilled by the present invention in a remarkably unexpected manner as will be readily discerned from the following detailed description of an exemplary embodiment thereof especially when read in conjunction with the accompanying drawing in which like parts bear like numerals throughout the several views.

DESCRIPTION OF THE PREFERRED EMBODIMENT

Figure 1:
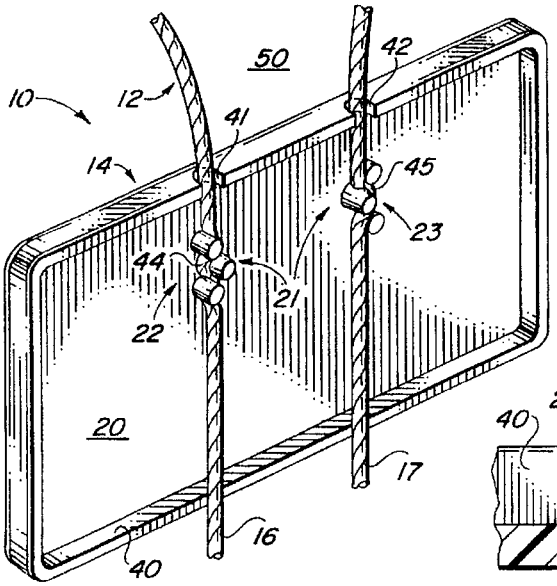
FIG. 1 is an isometric rear view of a bolo tie-type device of the present invention.

The present invention is a bolo tie-type device which is shown and identified in the attached drawing by the general reference numeral 10. As shown in FIG. 1, tie 10 generally comprises a bolo cord or string 12 and an ornamental display/securing device 14. Cord 12 preferably has decorative end attachments (not shown) which are known in the art and which, when desired, are affixed to the ends 16, 17 of cord 12.

Figure 6:
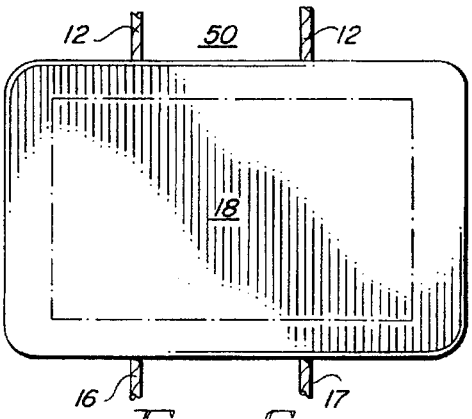
FIG. 6 is a plan view of the front display surface of the bolo tie-type device shown in FIG. 1.

Ornamental display/securing device 14 is a singular unit used to both display ornaments or functional devices (such as name tags or other forms of identification or display) and to secure and hold cord 12 in a desirable position around the neck of the wearer. The ornamental or identifying display occurs on the front surface 18 of device 14, as shown in FIG. 6, and this aspect is generally well understood in the art and requires no further elaboration here. As known, it can include art work or gem stones or metallic displays or, alternatively, name tags or other identification of the wearer as would be used at seminars, conventions, reunions, patient receiving stations, and the like where the need or simple desire to identify individuals within a group is indicated. Thus, only the securing function will be specifically addressed herein and for simplicity will hereafter be referred to merely as device 14.

Figure 2:
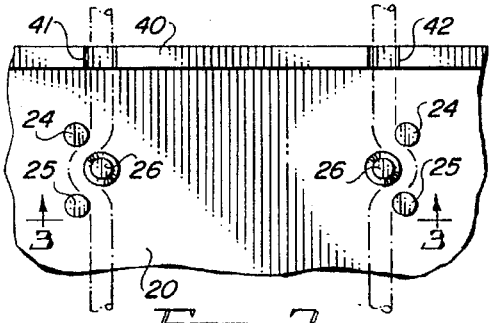
FIG. 2 is a plan view of a portion of the bolo tie-type device of FIG. 1.

Device 14 generally includes a rear plate-like surface, herein surface 20, having securing means 21 formed thereon. In one practice of the present invention, securing means 21 generally comprises two sets or formations 22, 23 respectively, of projections or "posts" as shown in FIGS. 1–5 and 7. Post formations 22, 23 constitute cord retaining or securing means to receive and secure cord 12 relative to device 14 to create a head circumscribing loop and to prevent involuntary movement of device 14 on cord 12. Each post formation 22, 23 includes three individual posts; an upper post 24, a lower post 25 and an intermediate post 26. Each of the upper and lower posts 24, 25 are mounted in vertical alignment with each other when device 14 is properly oriented for use. Each intermediate post 26 is preferably disposed slightly off this vertical alignment to define a generally triangular orientation as shown in FIG. 2. This triangular orientation imposes a serpentine-like configuration (as shown in phantom in FIG. 2) to that discrete portion of cord 12 which is fed through each post formation 22, 23.

Figure 3:
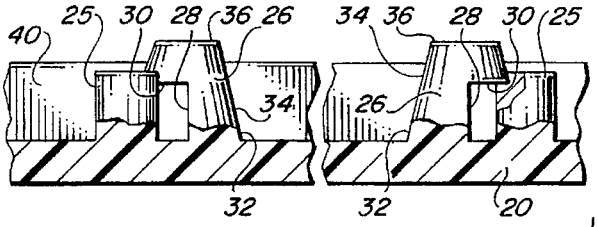
FIG. 3; a partially fragmented, cross-sectional view of the portion of the bolo tie-type device of FIG. 2 taken on line 3—3 thereof.
Figure 4:
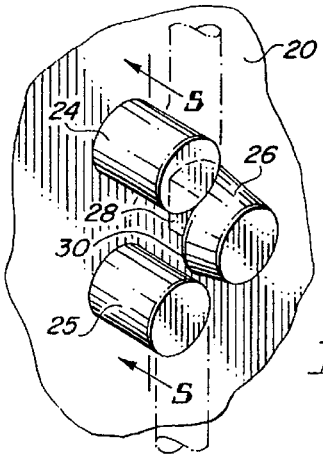
FIG. 4 is an enlarged isometric view of one portion of securing means of the present invention.
Figure 5:
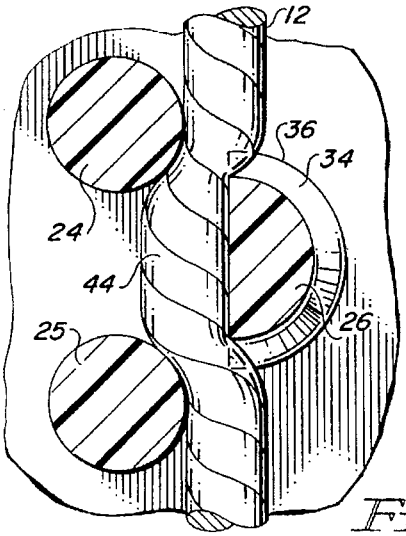
FIG. 5 is a cross-sectional view of the securing means of FIG. 4 taken on line 5—5 thereof.

As shown in FIGS. 3 and 4, each intermediate post 26 is preferably provided with a notch 28 which is cut therein on the lower interior side thereof to provide an overhanging lip 30 which coacts to retain cord 12 within each post formation 22, 23. When a notch 28 and lip 30 are used, intermediate post 26 may have other distinctive features as well. For example, as shown in FIGS. 3, 4, and 5, the base 32 of post 26 can be made broader than the corresponding bases of posts 24, 25 to give post 26 more mass at its attachment to plate 20 to make this a stronger attachment. Then, as shown, the exterior projecting surface 34 of post 26 may be sloped or slanted in a semi-conical shape up to its upper end 36 where less mass is required. Moreover, depending on the size and shape of the cord 12 to be used, post 26 with a notch/lip 28, 30 may need to be slightly taller than the associated upper and lower posts 24, 25.

Plate 20 also preferably has a circumferential ridge 40 projecting outwardly from the rear surface 20 thereof. In one practice, ridge 40 is generally as tall as or taller than posts 24, 25, 26 and aids in hiding the securing means 21 from casual view when device 10 is worn and will allow device 14 to lie flat against the chest of the user.

Cord 12 is preferably made of known tie string materials such as braided leather, cotton or synthetic materials. Numerous useful materials and cords are known and any and all varieties are intended to be successfully used herewith. Securing device 14 is preferably made of injection molded plastic but may be made of other conventional materials using known manufacturing processes which correspond to the material chosen. For example, metal worked using known methods for working such metals may be used. So also could stone, wood or other desirable natural and/or man-made materials which can be then cemented or otherwise formed in the appropriate configuration. Thus, any type of bolo tie-like ornamental display can be made into a bolo tie-type device 10 and employ the securing means described herein to secure ornamental display/securing device 14 at the desired location on a cord 12 when worn by a user.

Assembly takes place as follows. A first portion 44 of cord 12 adjacent one end of cord 12, for example end 16, is force fit into one set 22 of posts 24, 25, 26 and a second portion 45 of cord 12 adjacent the other end, for example end 17, is force fit into the other set 23 of posts. In one practice, cord portion 44 may be positioned in two steps, namely, by forcing cord 12 first between post 24 and its corresponding post 26; and thereafter forcing cord 12 between that post 26 and the corresponding post 25. Next, by slightly pulling on either or both ends of cord portion 44, cord portion 44 is fully seated within post formation 22 under lip 30 as shown in FIGS. 2 and 4 of the drawing. A similar process would then be used for placing cord portion 45 into post formation 23. Alternatively, cord 12 can be threaded laterally between each upper post 24 and its intermediate post 26, then under lip 30 and finally in between that intermediate post 26 and the corresponding lower post 25. If this latter process is used, then each cord end attachment (not shown) would likely have to be attached to each cord end 16, 17 after each cord end 16, 17 has been properly threaded through its corresponding post formation 22, 23. Conversely, when the force fit procedure is used, the cord end attachments could be fastened thereto either before or after cord 12 has been positioned.

When fully assembled, each bolo tie-type device 10 comprises a loop 50 (partially shown) of cord 12 disposed above securing device 14 and free ends 16, 17 exposed below securing device 14. Tie 10 is then ready for wear.

To use bolo tie-type device 10, the wearer simply inserts his/her head into and through loop 50 (as is known in the art) so that loop 50 rests on the back of the neck and shoulders of the wearer and securing device 14 is left exposed at the front. Then, securing device 14 is manually slid up toward the wearer's throat to its desired position by gripping the free ends 16, 17 of cord 12 with one hand to hold them while the other hand grasps securing device 14 and slides it upwardly into the desired position. Sufficient frictional and/or other applicable forces are established between posts 24, 25, 26 and cord 12 to maintain securing device 14 at whatever height it is positioned and involuntary slippage does not occur. In general, the closer the posts are disposed to each other (or the larger the cord), the stronger the frictional (or other applicable) holding power of the cord 12 will be. In one usage, cord 12 is placed under a common shirt collar and securing device 14 is moved all the way to the top button in the neckband as one would wear the knot of a common necktie. Tie 10 may also be worn loose such that connection device 14 may be positioned anywhere along cord 12 as desired.

Removal of device 10 from the wearer is accomplished by the reverse process, that is, securing device 14 is manually moved down sufficiently so that loop 50 can be simply removed from around the neck and head of the wearer.

Figure 7:
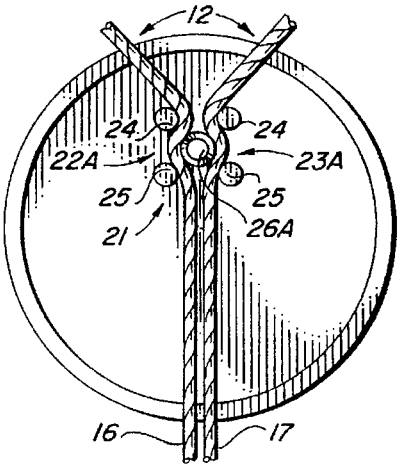
FIG. 7 is a rear plan view of an alternative embodiment of the present invention.

Other variations of securing means 21 which are believed within the scope of the present invention include the embodiment shown in FIG. 7 which involves a singular intermediate post 26A. In this embodiment, cord portion 44 engages one side thereof (while also engaging first set 22A of upper and lower posts 24, 25 while cord portion 45 simultaneously engages the other side thereof (while also engaging a second set 23A of posts 24, 25). Intermediate post 26A may also have the notch and lip configuration as shown in FIG. 4 and functions in a manner which is virtually equivalent thereto.

Another possible variation is in the number of posts used in each post formation 22, 23. However, regardless the number of posts employed, they must nonetheless coact to impose a serpentine-like configuration upon each portion of cord 12 disposed respectively within the separate sets 22, 23. Moreover, although it is preferable for each intermediate post 26 to be disposed inwardly of the respective vertical alignments of posts 24, 25, outward or alternating placements of such intermediate posts 26 relative to the others will provide equivalent results.

Also, while posts 24, 25 and 26 are shown disposed primarily in a perpendicular relationship to plate 20, these posts may be angled somewhat from the perpendicular without losing the beneficial result. For example, each post may be tilted inwardly toward cord 12 to hang over cord 12 and thereby hold cord 12 within the respective post formation 22, 23 to further prevent the withdrawal of cord 12 from securing device 14. Thus, tilted posts can be used to assist with or separately perform the function of notch 28 and lip 30 in holding cord 12. Furthermore, tilted posts 24, 25, 26 could still be provided with corresponding notches 28 and lips 30.

Many different shapes may be used for plate 20. Circular (see e.g., FIG. 7), rectangular and other geometric and/or odd shapes are envisioned to be used herewith. Also, ridge 40 may optionally have two notches 41, 42 cut therein one each above each post formation 22, 23. These are shown most clearly in FIG. 1. Notches 41, 42 are used to receive and guide distinct portions of cord 12 when tie 10 is being worn to assist in holding tie in the proper desired orientation.

Front surface 18 of securing device 14 is preferably a flat surface to which ornamental display or functional indicia (not shown) are attached. In one practice, such displays or indicia are directly affixed, glued, etc. thereto. In another embodiment, such as when device 14 is used for name tags and like identification, a name card (not shown) made of paper or the like is simply set on surface 18, and a clear plastic cover or envelope is disposed over the card and around the edges of device 14 to hold the card operably in place. Such a plastic cover may be simply thermally heated and vacuum formed to the proper desired size and may be held secure by frictional fit, spurred edges which catch the back surface of device 14, or by clips or other equivalent means.

From the foregoing, it is readily apparent that a new and useful embodiment of the present invention has been herein described and illustrated which fulfills all of the aforestated objects in a remarkably unexpected fashion. It is of course understood that such modifications, alterations and adaptations as may readily occur to the artisan confronted with this disclosure are intended within the spirit of this disclosure which is limited only by the scope of the claims appended hereto.

Accordingly, what is claimed is:

1. A bolo tie-type device comprising: a cord and a securing device, said securing device having a front surface and a back surface, said back surface having a first set and a second set of three posts, each projecting therefrom in spaced relationship to each other, each said set of three posts being arranged in a triangular plan formation to receive and secure a different portion of said cord therebetween.

2. A bolo tie-type device according to claim 1 in which said posts extend generally orthogonally from said back surface of said plate.

3. A bolo tie-type device according to claim 1 in which at least one of said posts in each of said sets of three posts has an upper lip formed therein to further hold said corresponding portion of said cord within said set of three posts.

4. A bolo tie-type device according to claim 1 in which said back surface of said plate has a peripheral ridge projecting therefrom, said ridge having two distinct notches defined therein to receive and guide a different intermediate portion of said cord when said bolo tie-type device is in use.

5. A bolo tie-type device according to claim 1 in which at least one of said posts in each of said sets of three posts is angled inwardly toward the other posts in said set for coaction therewith to further secure said corresponding portion of said cord therewithin.

6. A bolo tie-type device comprising: a cord and a securing device, said securing device having a plate with a front surface and a back surface, said back surface having a plurality of posts projecting therefrom in spaced relationship to each other, said plurality of posts comprising a first and a second set of posts, each said set of posts having at least an upper post, a lower post and an intermediate post, said set of posts coacting with a different portion of said cord to impose a serpentine-like configuration thereto and secure each said portion of said cord thereby.

7. A bolo tie-type device according to claim 6 in which said posts extend generally orthogonally from said back surface of said plate.

8. A bolo tie-type device according to claim 7 in which at least one of said plurality of posts has an upper lip formed therein to further hold the corresponding one of said two portions of said cord therewithin.

9. A bolo tie-type device according to claim 6 in which said back surface of said plate has a peripheral ridge projecting therefrom, said ridge having two distinct notches defined therein to receive and guide a different intermediate portion of said cord when said bolo tie-type device is in use.

10. A bolo tie-type device according to claim 6 in which at least one of said posts is angled inwardly toward the other posts to coact therewith to further secure the corresponding one of said portions of said cord therewithin.

11. A bolo tie-type device according to claim 6 in which said plurality of posts comprises a singular intermediate post and at least a first post and a second post disposed on opposing lateral sides of said intermediate post to impose said serpentine-like configurations corresponding on portions of cord.

12. A bolo tie-type device comprising: a cord means, a display means, and securing means for securing distinct portions of said cord means to said display means to define a loop relative to said display means; said display means having a front surface and a back surface, said back surface having a peripheral ridge projecting therefrom, said ridge having two distinct notches defined therein to receive and guide a different intermediate portion of said cord means therethrough, said securing means having a plurality of posts attached to and projecting from said back surface, said plurality of posts coacting with a different portion of said cord to impose a serpentine-like configuration on each corresponding portion of said cord means and secure each said portion thereby.

13. A bolo tie-type device according to claim 12 in which of said posts project generally orthogonally from said back surface of said display means.

14. A bolo tie-type device according to claim 13 in which at least one of said posts is disposed intermediate of and offset relative to the other posts and has an upper lip formed thereon to further hold said corresponding portion of said cord means within said plurality of posts.

15. A bolo tie-type device according to claim 12 in which at least one of said posts in said plurality of posts has an exterior surface which angled toward its coactive posts for coaction therewith to further secure said corresponding portion of said cord means therewithin.

16. A bolo tie-type device according to claim 12 in which said plurality of posts comprises a first and a second set of posts, each said set having at least an upper post, a lower post and an intermediate post.

17. A bolo tie-type device according to claim 12 in which said plurality of posts comprises a common intermediate post and at least a first post and a second post disposed on opposing lateral sides of said intermediate post to impose said serpentine-like configuration on corresponding portions of said cord.

* * * * *

UNITED STATES PATENT AND TRADEMARK OFFICE

CERTIFICATE OF CORRECTION

PATENT NO. : 5,664,297

DATED : September 9, 1997

INVENTOR(S) : CHANT H. MANOUKIAN

It is certified that error appears in the above-identified patent and that said Letters Patent is hereby corrected as shown below:

Title page, Item [76],

INVENTOR'S NAME IS: CHANT H. MANOUKIAN

CLAIM 13, line 1, after "which" insert --- each ---

Signed and Sealed this

Thirtieth Day of December, 1997

Bruce Lehman

*Attest:*

BRUCE LEHMAN

*Attesting Officer*

*Commissioner of Patents and Trademarks*